US008581086B2

(12) United States Patent
McMillen et al.

(10) Patent No.: US 8,581,086 B2
(45) Date of Patent: Nov. 12, 2013

(54) COMPUTER INTERFACE FOR POLYPHONIC STRINGED INSTRUMENTS

(75) Inventors: Keith McMillen, Berkeley, CA (US); Chris Shaver, San Francisco, CA (US)

(73) Assignee: Kesumo, LLC, Berkeley, CA (US)

( * ) Notice: Subject to any disclaimer, the term of this patent is extended or adjusted under 35 U.S.C. 154(b) by 0 days.

(21) Appl. No.: 13/165,587

(22) Filed: Jun. 21, 2011

(65) Prior Publication Data

US 2011/0303075 A1 Dec. 15, 2011

Related U.S. Application Data

(62) Division of application No. 12/501,015, filed on Jul. 10, 2009, now abandoned.

(60) Provisional application No. 61/079,691, filed on Jul. 10, 2008.

(51) Int. Cl.
*G10H 7/00* (2006.01)

(52) U.S. Cl.
USPC ..... 84/645

(58) Field of Classification Search
USPC ..... 84/645
See application file for complete search history.

(56) References Cited

U.S. PATENT DOCUMENTS 4,630,520 A 12/1986 Bonanno
4,702,141 A 10/1987 Bonanno
4,730,530 A 3/1988 Bonanno
4,748,887 A 6/1988 Marshall
4,817,484 A 4/1989 Iba et al.
4,823,667 A 4/1989 Deutsch et al.
5,024,134 A * 6/1991 Uchiyama ..... 84/654
5,085,119 A 2/1992 Cole
5,113,742 A 5/1992 Matsumoto
5,140,890 A 8/1992 Elion
5,212,551 A 5/1993 Conanan
5,218,160 A 6/1993 Grob-Da Veiga
5,245,128 A 9/1993 Araiza
5,270,475 A 12/1993 Weiss et al.
5,308,916 A 5/1994 Murata et al.
5,393,926 A 2/1995 Johnson
5,591,931 A 1/1997 Dame
5,670,729 A 9/1997 Miller et al.
5,723,802 A * 3/1998 Johnson et al. ..... 84/609
5,773,742 A 6/1998 Eventoff et al.
5,789,689 A 8/1998 Doidic et al.
5,799,036 A 8/1998 Staples
5,866,834 A 2/1999 Burke et al.
5,942,709 A * 8/1999 Szalay ..... 84/616
5,973,253 A 10/1999 Hirata
5,990,405 A 11/1999 Auten et al.

(Continued)

OTHER PUBLICATIONS

Puckette, M. and Apel, T. 1998. "Real-time audio analysis tools for Pd and MSP". Proceedings, International Computer Music Conference. San Francisco: International, Computer Music Association, pp. 109-112.

(Continued)

*Primary Examiner* — Jianchun Qin
(74) *Attorney, Agent, or Firm* — Weaver Austin Villeneuve & Sampson LLP

(57) ABSTRACT

An interface device is described that allows the audio signals from a polyphonic stringed instrument to be introduced into a personal computer environment for feature extraction and signal processing.

32 Claims, 16 Drawing Sheets

(56) References Cited

U.S. PATENT DOCUMENTS

| | | | | |
|---|---|---|---|---|
| 6,111,186 | A | 8/2000 | Krozack et al. | |
| 6,175,070 | B1 | 1/2001 | Naples et al. | |
| 6,350,942 | B1 | 2/2002 | Thomson | |
| 6,353,169 | B1 | 3/2002 | Juszkiewicz et al. | |
| 6,611,206 | B2 * | 8/2003 | Eshelman et al. | 340/573.1 |
| 6,686,530 | B2 | 2/2004 | Juszkiewicz et al. | |
| 6,787,690 | B1 | 9/2004 | Celi et al. | |
| 6,888,057 | B2 | 5/2005 | Juszkiewicz et al. | |
| 6,969,797 | B2 | 11/2005 | Brinkman et al. | |
| 7,220,912 | B2 | 5/2007 | Juszkiewicz et al. | |
| 7,220,913 | B2 | 5/2007 | Juszkiewicz et al. | |
| 7,223,913 | B2 | 5/2007 | Knapp et al. | |
| 7,241,948 | B2 | 7/2007 | Cummings | |
| 7,279,631 | B2 | 10/2007 | Celi et al. | |
| 7,399,918 | B2 | 7/2008 | Juszkiewicz et al. | |
| 7,420,112 | B2 | 9/2008 | Juszkiewicz et al. | |
| 7,446,253 | B2 | 11/2008 | Knapp et al. | |
| 7,563,977 | B2 | 7/2009 | Cummings | |
| 7,565,214 | B2 | 7/2009 | Niiyama et al. | |
| 7,799,986 | B2 | 9/2010 | Ryle et al. | |
| 7,812,243 | B2 | 10/2010 | Celi et al. | |
| 2002/0005108 | A1 | 1/2002 | Ludwig | |
| 2003/0159570 | A1 | 8/2003 | Toshitani | |
| 2004/0103776 | A1 | 6/2004 | Juszkiewicz et al. | |
| 2004/0144241 | A1 | 7/2004 | Juszkiewicz et al. | |
| 2004/0168566 | A1 | 9/2004 | Juszkiewicz et al. | |
| 2004/0187673 | A1 | 9/2004 | Stevenson | |
| 2004/0261607 | A1 | 12/2004 | Juszkiewicz et al. | |
| 2005/0045027 | A1 | 3/2005 | Celi et al. | |
| 2006/0101987 | A1 | 5/2006 | Celi et al. | |
| 2006/0107826 | A1 | 5/2006 | Knapp et al. | |
| 2006/0196348 | A1 | 9/2006 | Cummings | |
| 2007/0089594 | A1 | 4/2007 | Juszkiewicz et al. | |
| 2007/0227341 | A1 | 10/2007 | Lori | |
| 2007/0227344 | A1 * | 10/2007 | Ryle et al. | 84/723 |
| 2008/0047414 | A1 | 2/2008 | Friedman et al. | |
| 2008/0047416 | A1 | 2/2008 | Cummings | |
| 2008/0223202 | A1 | 9/2008 | Shi | |
| 2008/0276794 | A1 | 11/2008 | Juszkiewicz et al. | |
| 2008/0317066 | A1 | 12/2008 | Trine et al. | |
| 2010/0037755 | A1 | 2/2010 | McMillen | |
| 2010/0242712 | A1 | 9/2010 | Lazovic | |
| 2010/0263521 | A1 | 10/2010 | Lerymenko et al. | |

OTHER PUBLICATIONS

ZIPI MPDL Computer Music Journal MIT Press Winter 1994.
Puckette, M. 2007. "Patch for Guitar." On-line proceedings, Pd-convention (http://pure-data.ca/en/).
Ben & Nelson, Speech and Audio Signal Processing, John & Wile Sons, Inc. Chapters 10 and 35.
Notification of Transmittal of the Interantional Search Report and the Writtenn Opinion of the International Searching Authority dated Jan. 29, 2010, PCT Application No. PCT/US2009/050275.
Office Action dated Dec. 29, 2010, U.S. Appl. No. 12/501,015.
Zeta Music Systems, http://www.zetamusic.com, retrieve from the Internet, May 14, 2012, URL: http://zetamusic.openfos.com/.
Synful Orchestra, retrieved from the Internet, Dec. 28, 2010, URL: http://www.synful.com.

* cited by examiner

| Param | Bytes | Units | Behaviour |
|---|---|---|---|
| On/Off Articulation | 1 | | |
| Continuous Pitch | 2 | Semitone.Fractional (256.256 (60.00 = mid C)) | |
| Triggered Pitch (note #) | 1 | 0-127 MIDI 1 format | |
| Triggered Amp (velocity) | 1 | 0-127 MIDI 1 format | 0 does not turn off |
| Deviation from Trig'd Pitch (bend) | 2 | signed semitone.fractional (+/- 127.256) | |
| Continuous Amp | 1 | dB in .5dB increments | multiplicative |
| Centroid | 2 | Freq - Semitone.Fractional | multiplicative |
| Even/Odd | 1 | 1=odd 127=50% 255 = even | multiplicative |
| Noise Amt | 1 | dB in .5dB increments | multiplicative |
| Noise Centroid | 2 | Freq - Semitone.Fractional | multiplicative |
| Inharmonicity | 1 | 1=126%squeezed 127=none 255 = 126% stretched | multiplicative |
| reserved | 1 | reserved | |
| **Packet size** | **16** | is 128 bits | |

*FIG. 8*

COMPUTER INTERFACE FOR POLYPHONIC STRINGED INSTRUMENTS

RELATED APPLICATION DATA

The present application is a divisional of and claims priority under 35 U.S.C. 120 to U.S. patent application Ser. No. 12/501,015 for COMPUTER INTERFACE FOR POLYPHONIC STRINGED INSTRUMENTS filed on Jul. 10, 2009, now abandoned, which claims priority under 35 U.S.C. 119(e) to U.S. Provisional Patent Application No. 61/079,691 for COMPUTER INPUT DEVICE FOR POLYPHONIC STRINGED INSTRUMENTS filed on Jul. 10, 2008, the entire disclosure of each of which is incorporated herein by reference for all purposes.

BACKGROUND OF THE INVENTION

The present invention relates to interfaces between musical instruments and computing devices and, in particular, to interfaces for polyphonic stringed instruments.

While the electronic keyboard has been married to synthesis control since its inception, stringed instruments have basically had no entry method for computer interface appropriate for this instrument family. The only available solutions have been bulky and expensive hardware devices that reduce the nuance of a stringed instrument to keyboard-like MIDI commands or rigid signal processing chains.

SUMMARY OF THE INVENTION

According to a particular class of embodiments of the present invention, a computer interface for a polyphonic stringed instrument is provided. An analog interface is configured to receive a plurality of individual analog audio signals. Each analog audio signal corresponds to one of a plurality of strings of the stringed instrument. Analog-to-digital conversion (ADC) circuitry is configured to convert each of the analog audio signals to a corresponding digital audio signal. A processor is configured to combine the digital audio signals into a single serial data stream. A serial data interface is configured to transmit the serial data stream to a computer system.

According to another class of embodiments, methods, apparatus, and computer program products are provided for processing audio signals for a stringed instrument. A serial data stream is received with a serial data interface of a computing device. The serial data stream encodes a plurality of digital audio signals. Each digital audio signal represents one of a plurality of strings of the stringed instrument. The encoded digital audio signals are extracted from the serial data stream using the computing device. Each of the extracted digital audio signals is processed with the computing device, thereby generating a plurality of processed digital audio signals. Each of the processed digital audio signals corresponds to one of the plurality of strings of the stringed instrument.

A further understanding of the nature and advantages of the present invention may be realized by reference to the remaining portions of the specification and the drawings.

BRIEF DESCRIPTION OF THE DRAWINGS

FIG. 8 is a table illustrating a message format for use with various embodiments of the invention.

DETAILED DESCRIPTION OF SPECIFIC EMBODIMENTS

Reference will now be made in detail to specific embodiments of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims. In the following description, specific details are set forth in order to provide a thorough understanding of the present invention. The present invention may be practiced without some or all of these specific details. In addition, well known features may not have been described in detail to avoid unnecessarily obscuring the invention.

Various embodiments of the present invention relate to devices and related techniques that enable the conversion of polyphonic string audio to digital form for use by various types of applications including, for example, feature extraction and signal processing applications. Embodiments of the invention provide an interface that converts the polyphonic output of any stringed instrument for presentation to a general purpose computer where the converted data may be processed in more sophisticated and elaborate ways than previous integrated solutions in which only limited types of processing are enabled in bulky, stand-alone boxes. Specific implementations of an interface designed in accordance with a particular class of embodiments (referred to herein as the StringPort) are described below.

Figure 1:
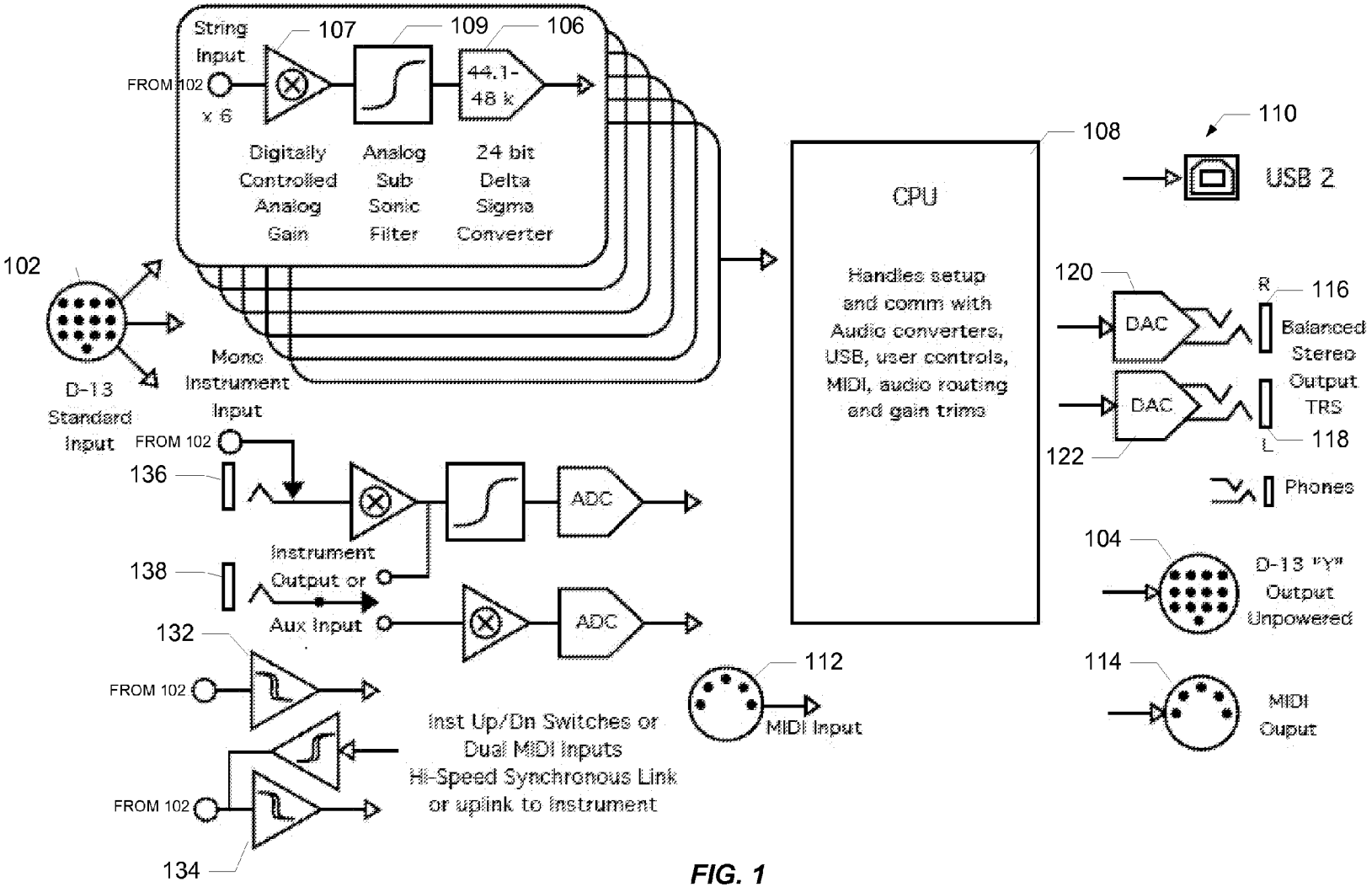
FIG. 1 is a simplified diagram of a specific embodiment of the invention.
Figure 2:
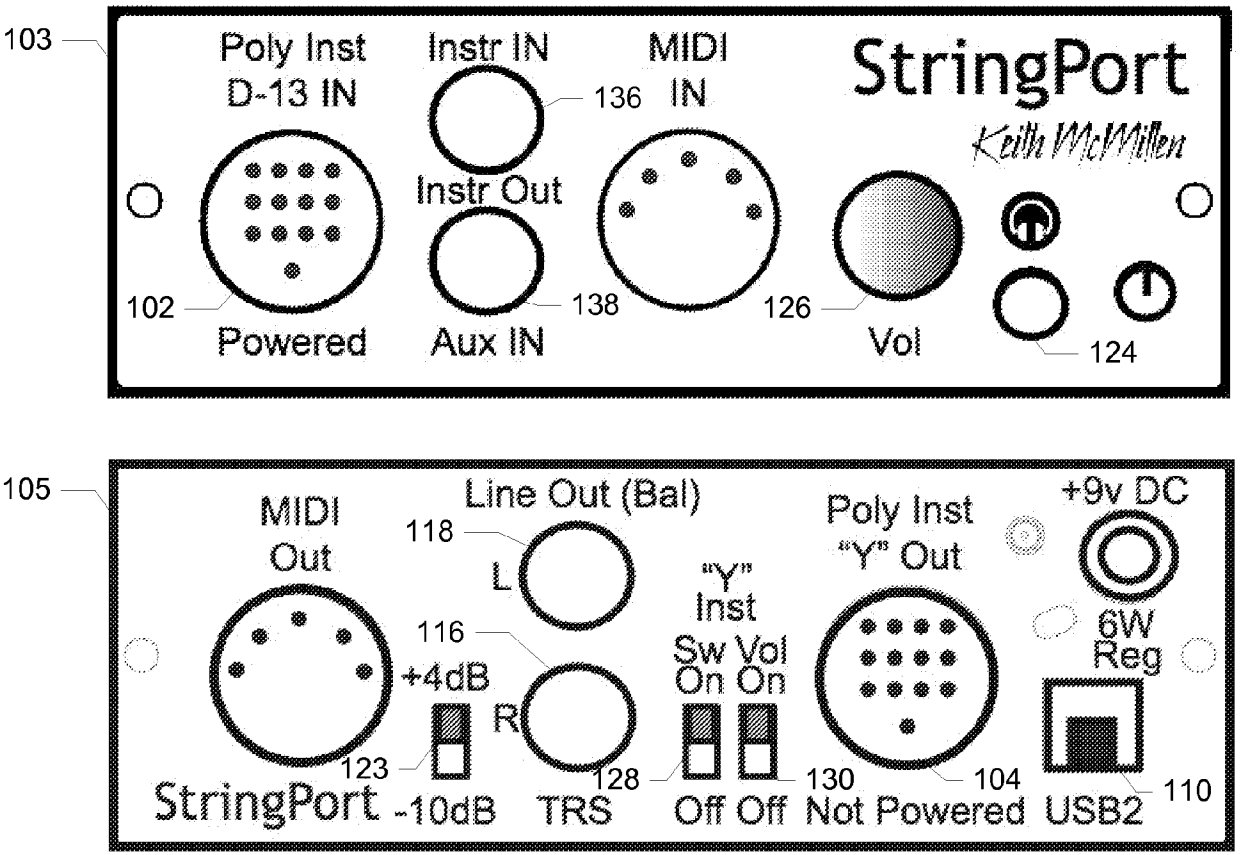
FIG. 2 shows the front and back panels of a specific embodiment of the invention.

According to a specific embodiment illustrated in FIGS. 1 and 2, the StringPort accepts polyphonic string audio through an industry standard Din 13 connector 102 on the front panel 103 of the StringPort. The depicted embodiment assumes a pickup system (not shown) on the stringed instrument that has one or more dedicated transducers for each string such as, for example, the Zeta Violin family or Roland/Yamaha guitar pickup systems. It will be understood that other suitable pickup systems may also be employed. In this example, Din 13 connector 102 transfers six strings of audio as well as a monophonic summed audio signal. It should be noted that embodiments are contemplated in which fewer or more string signals may be handled.

A second Din 13 connector 104 is located on the rear panel 105 of the StringPort and acts as a "pass through" for some or all of the signals presented to input Din 13 connector 102. Back panel switches 128 and 130 on the StringPort allow the user to pass a volume control voltage (e.g., to affect a voltage controlled amplifier in an attached legacy device) and to switch options such as, for example, program selection, as signal data to Din 13 connector 104. Such pass through signals may, for example, be provided for use with legacy equipment.

Internally, the StringPort conveys the seven audio signals (i.e., 6 polyphonic string signals and one "sum of" signal often from a different pickup system or microphone on the instrument) and one auxiliary signal to eight high quality Delta Sigma analog-to-digital converters (e.g., ADC 106). In this example, each audio signal passes through a digitally controlled gain stage 107, is filtered 109, and then converted to 24-bit data at either a 44.1 KHz or 48 kHz sample rate. Subsonic analog filters 109 are intended to eliminate movement and/or displacement noise from string displacement caused, for example, by change of bow direction or body and bridge noise caused by vibrato style bridges). Such noise is typically relatively low frequency noise, and is undesirable in that it can move the analog input to the ADC out of the optimal range, as well as present artifacts after conversion which interfere with subsequent digital signal processing.

A central processing unit (CPU) 108, or the equivalent (which may be implemented using any of a wide variety of devices including, for example, conventional processors and controllers as well as custom integrated circuits), extracts and formats the eight serial digital audio streams from the ADCs and conveys them efficiently to a universal serial bus (USB) transport PHY and connector 110. The output audio signals may then be transported within the connected computer(s) in any of a wide variety of formats, e.g., Audio Stream Input/Output (ASIO) or Core Audio signals, depending on the operating system of the computer (not shown) to which the StringPort connects. ASIO is a computer soundcard driver protocol for digital audio. Core Audio is a low-level API for dealing with sound in Apple's Mac OS X operating system. More generally, drivers may be provided for any of a variety of operating systems such as, for example, Mac OS X, Windows OS, and Linux.

USB interface 110 may comprise any of the variety of serial bus interfaces associated with the USB family of standards including, for example, USB 1.0, 2.0, or 3.0, and may employ any of the communication protocols within that family of standards. More generally, embodiments of the present invention are contemplated which may employ a much wider array of serial bus interfaces such as, for example, Firewire. Therefore, references to USB technologies should not be considered to unduly limit the scope of the present invention.

According to some embodiments, a variety of additional information regarding the string signals and the manner in which the instrument is being played may be generated from the StringPort output by a host application on one or more connected computers. According to some embodiments, this additional information is provided in such a format so as to make it accessible and useful to a wide variety of commercially available synthesis applications. A particular format is discussed below. Such information might include, for example, frequency—e.g., the continuous pitch of the fundamental harmonic of the string, amplitude—e.g., the continuous measurement of energy of the strings vibration, triggers—e.g., whether the string is active and when the string starts its activity based upon the user picking or bowing or otherwise energizing the string, centroid—e.g., a measure of the brightness or timbre of a string measured as the spectral balance point at the center of amplitude weighted partials expressed as a frequency, even/odd—e.g., the ratio between even and odd harmonics, noise—e.g., the level of energy that is not harmonic usually created by the bow and or picking style, spectrum—e.g., the continuous representation of the sound as a collection of partials or harmonic components, etc.

According to a particular class of implementations, gestural information (e.g., fret scanning data, accelerometer outputs, surfaces, etc.) is provided to the host application via the StringPort via the Din 13 cable coming from the instrument. Polyphonic pickups often include "up" and "down" switches which typically convey relatively low frequency "on" or "off" states or select the next or last preset of variables controlling the synthesized or processed audio. According to a particular implementation, these switch signals are repurposed for transmission of digital signals (e.g., high speed data superimposed on the primary signals) that may be used for a variety of advanced signal processing purposes. For example, the superimposed data might represent gestural information from the instrument such as string length. Such information might be generated, for example, by fret scanning sensors which can identify the finger positions of the musician before string vibration even begins. Other information might include, but is not limited to fingerboard scanning data, accelerometer data, touch surface data, knob data, switch data, slider data, hall effect sensor data, optical sensor data, pressure sensor data, proximity detector data, gyroscope data, breath controller data, etc.

According to a specific embodiment, this information is provided in MIDI format, but is not necessarily limited to MIDI data rates. An uplink path may also be provided to control behavior of the instrument which would conventionally be under control of the user through switch or knob settings directly on the instrument. This allows a preset on the host application to control and change the instrument's sound or other advanced features such as string sustainers or mechanical/acoustic modifiers that directly affect the way the string vibrates.

In addition to the polyphonic audio stream, three digital data paths are conveyed to the computer. MIDI in and out connectors 112 and 114 allow users to add standard peripherals such as foot pedals and other controllers. Din 13 connector 102 may supply analog control signals such as a volume potentiometer and select switches from the instrument through the cable. These signals may then be converted and conveyed to the computer via Din 13 connector 104.

According to one embodiment, a beefed up power supply is provided to the instrument with a separate return path via the Din 13 connector in anticipation of power needs for embedded processing within the instrument. The supply is intended to be sufficient to handle any reasonable load in a guitar (e.g., up to a couple of watts), and the return path (via an unused wire in the cable) will help keep the audio clean. Finally, two separate serial data input streams are supplied. These are represented by comparators 132 and 134 which receive their inputs from Din 13 connector 102. According to a specific embodiment and as mentioned above, these datapaths may be used to transfer fingerboard tracking information (e.g., fret scanning information as was used in the Zeta Mirror Six guitar) allowing a more rapid and robust pitch extractor. Other uses include transferring gestural data such as pressure sensors, joy sticks, accelerometers which can be mounted in or on the instrument. All data paths are tagged then merged in the StringPort and appear to the OS of the connected computer as a single input of MIDI data or other data formats such as UDP.

The ¼" jacks (136 and 138) on the front panel allow the user to insert a summed mono signal of the instruments sound to replace the summed instrument sound that normally travels down the D13 cable. This allows the user to modify the sound of this signal before it enters the StringPort and then the Host PC. This same signal is available through a second ¼" jack so a user can process the analog signal in parallel with the digital signal path within the host PC. Under user selection from the StringPort host application on the Host PC, the user can reconfigure this $2^{nd}$ ¼" jack (138) as an auxiliary input for additional analog inputs, e.g., other instruments or microphones, to be encoded in the serial data output. This jack may also offer phantom power so a microphone can be directly used without any additional powered preamps making the entire performance system more compact and reliable.

A pair of outputs 116 and 118 provide a high quality stereo representation of the string input signals via CPU 108 and digital-to-analog converters (DACs) 120 and 122. That is, the stereo signal may be a representation of processed versions of the plurality of digital audio signals received back from the computer system. Alternatively, the stereo signal may be synthesized audio rendered with reference to any information extracted from the plurality of digital audio signals or serial data stream by the computer system. According to a specific implementation, these outputs are differential ¼" jacks with switchable −10 and +4 dB levels (e.g., using switch 123). A 3.5 mm headphone jack 124 and volume control 126 are present on the front panel.

According to a particular implementation, the electronics of the StringPort are enclosed in an aluminum extruded chassis measuring roughly 4"×1.5"×5" (W×H×D). This implementation of the StringPort is designed such that up to four units can fit in a single IU rack space (using a rack mount adapter accessory), anticipating compact portable stage-worthy support for string quartets. Since power requirements approach the limits of USB powered devices, a rear mounted power jack and universal power supply may also be provided to ensure reliable operations.

According to a particular class of embodiments, the StringPort host application on the computer(s) to which the StringPort is connected includes real-time event detection and classification capabilities. Prior attempts at reliably detecting events such as, for example, the beginning of a note, have generated unsatisfactory results. The inadequacy of such previous techniques may be understood with reference to the example of a large string (e.g., a bass string) which is struck by the musician multiple times in succession. That is, when the musician strikes the string the first time, it begins at rest, and therefore the interaction may be detected fairly reliably. However, when the musician strikes the string a second time while the string is still vibrating, the energy of the string may not change sufficiently for conventional techniques to detect the event. Therefore, embodiments of the invention have been provided which address the limitations of previous techniques.

Figure 3:
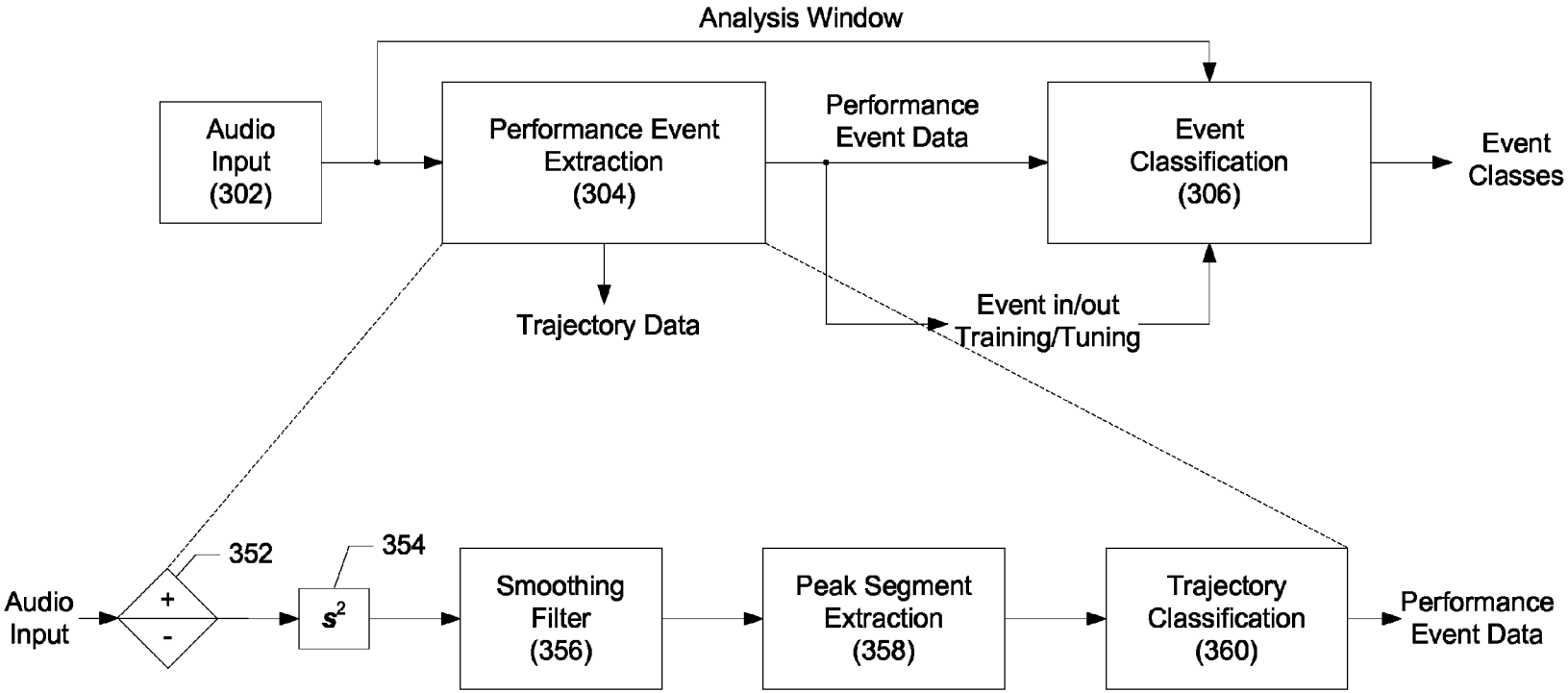
FIG. 3 is a simplified block diagram illustrating operation of a specific embodiment of the invention.

According to one such embodiment illustrated in FIG. 3, the real-time detection and classification of events produced by string instrument performance may be represented as a two stage system which receives a digital representation of each individual string's audio (302) from the StringPort, identifies event candidates (304), and then classifies the event candidates using various characteristics (306). Classification includes classifying some event candidates as to be ignored. According to a specific embodiment, the first stage classifies peak segments separately for positive and negative parts of an audio signal into trajectories composed of peak segments similar in constituency. The second stage of the system classifies events with a set of neural networks, determining inclusiveness from a set of time-series, frequency, and statistical information about the signal.

According to a particular class of implementations, event types or classifications correspond to various types of performance techniques, e.g., picks, plucks, taps, etc. In addition, event data for each event identified may include information regarding various characteristics of the event such as, for example, its intensity. The identification and classification of events in real time can be advantageous, for example, in enabling a synthesizer or similar generative device to produce an output corresponding to the "attack" of an instrument performance, i.e., how quickly a signal reaches full amplitude. This is particularly the case where, as with some embodiments of the invention, events are determinable prior to the availability of pitch information or other more conventionally derived envelope characteristics. Additional data from the system can be used to modify the processes initiated by the event to emulate the response of the stringed instrument to the performance from which the event had been generated.

Figure 4:
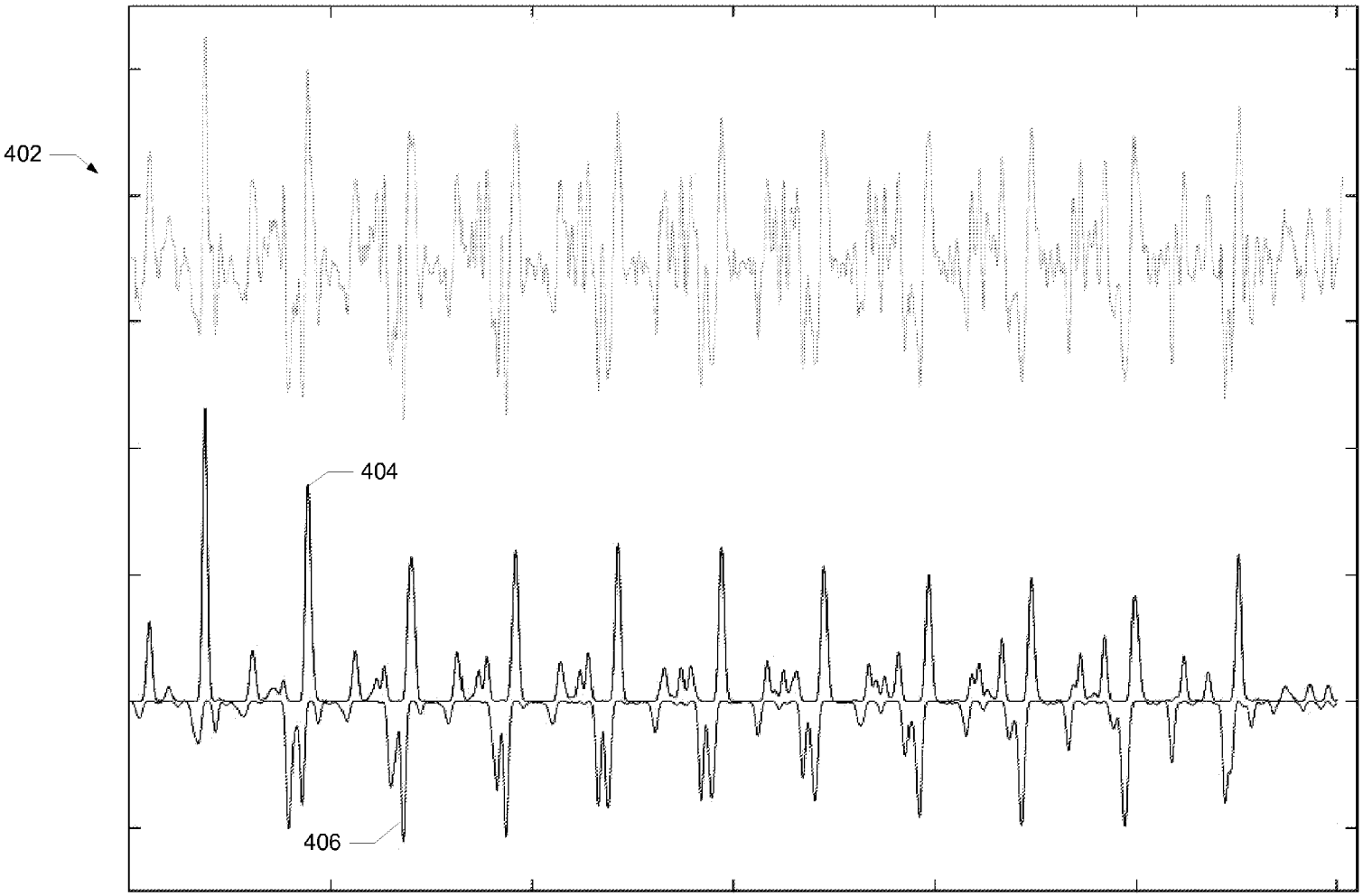
FIGS. 4-7 are graphs illustrating various aspects of the operation of a specific embodiment of the invention.

According to the specific embodiment illustrated in FIG. 3, event extraction may be subdivided into three stages: preprocessing of the audio signal, extraction of peak segments as atomic events, and classification of the atomic events into trajectories while maintaining a set of active trajectories. The audio signal sent into the system is first divided into two parallel segments, one corresponding to the positive part of the audio signal and one corresponding to the negative part (352). This may be understood with reference to the graph of FIG. 4 in which audio input signal 402 is shown in comparison with corresponding positive and negative signals 404 and 406. Although not depicted in FIG. 3, it should be noted that the topology of the system bifurcates upon this division into two parallel pathways that each extract peak segments independently as discussed below. As will be described, a set of trajectories for each part of the signal is kept in parallel, and shared information between sets is used to determine the correspondence of positive and negative peaks.

Each audio signal segment is squared (354) and passed through a smoothing filter (356) to mitigate roughness in the signal and to simplify the identification of the peak segments. According to a specific embodiment, the smoothing filter is a finite impulse response (FIR) filter morphologically similar to the shape of a typical peak segment and is constructed as a 64-sample Gaussian window having a precision of around 0.1. Typically, the smoothing filter has a low frequency response to remove sharp quick changes. As will be understood by those of skill in the art, depending on the relevant frequency range of the audio being processed, a suitable filter may be chosen from among a wide range of alternatives. For example, for higher frequency instrument strings, the peaks are usually sharper and more coherent making smoothing less important and allowing narrower, higher roll-off smoothing filters to be used.

Figure 5:
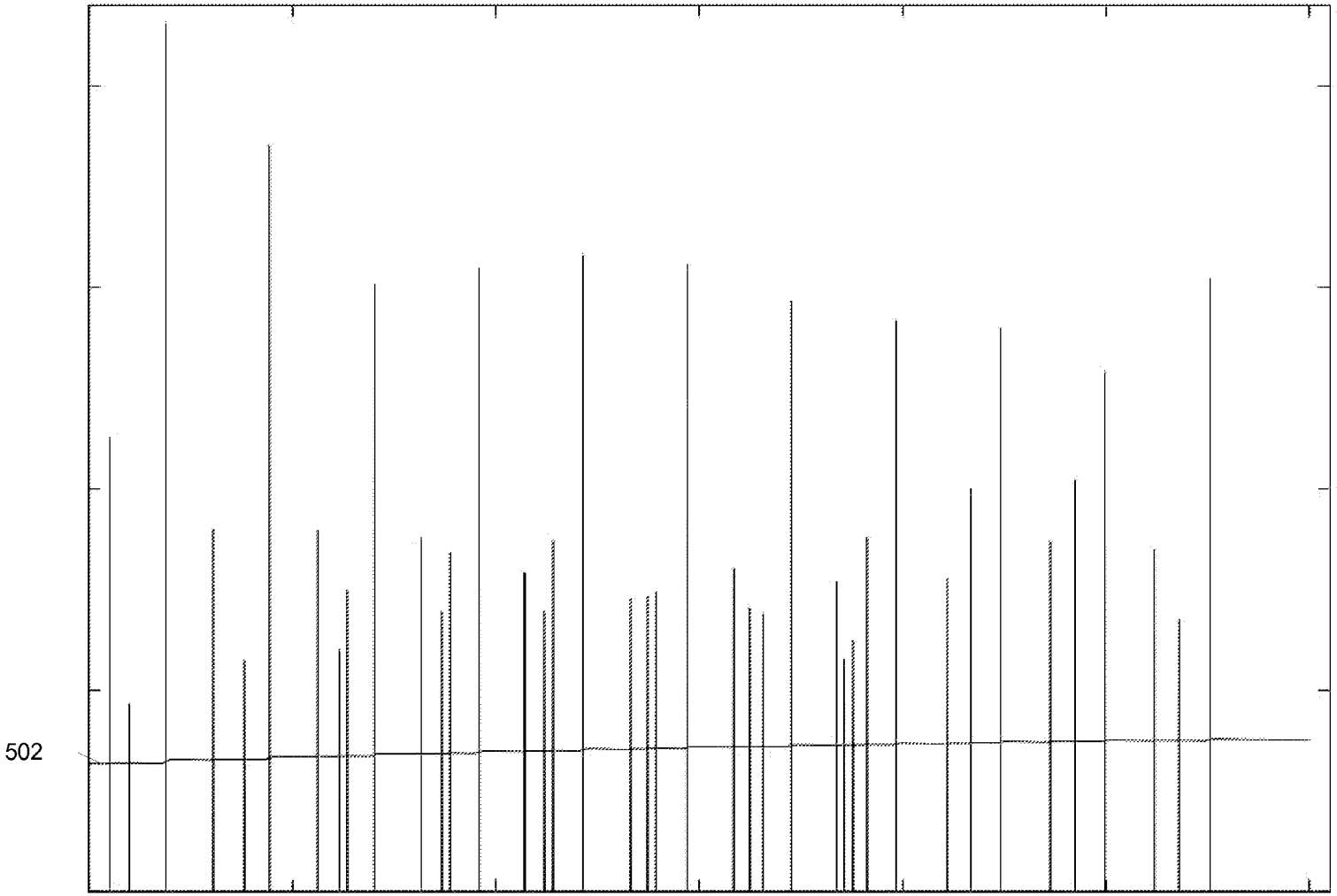

For each preprocessed segment of audio, peak segments are extracted and recorded as events (358) which are then classified in trajectories (360). According to one approach, the initial and final boundaries of a peak segment are determined by the processed signal rising above and falling below a threshold, respectively. This threshold may be a constant or, alternatively, be maintained adaptively with reference, for example, to the amplitude of the segment. An illustration of peak locations relative to a threshold 502 is shown in FIG. 5.

Within a peak segment itself, metrics relating to the general characteristics of the peak are acquired. Such peak segment metrics may include, for example, the maxima, the width, the average amplitude, and higher moments of the peak segment. When the final boundary of a peak segment is reached, an event is generated which includes data about the peak. These data may include, for example, the amplitude of and position of the maxima within the segment, the metrics measured about the peak, and derivative metrics such as the variance, tilt, and kurtosis of the segment. A terminal heuristic check may also be performed on the generated events to throw out events that are exceptionally small, squat, or otherwise unfitting of further consideration and classification.

Figure 6:
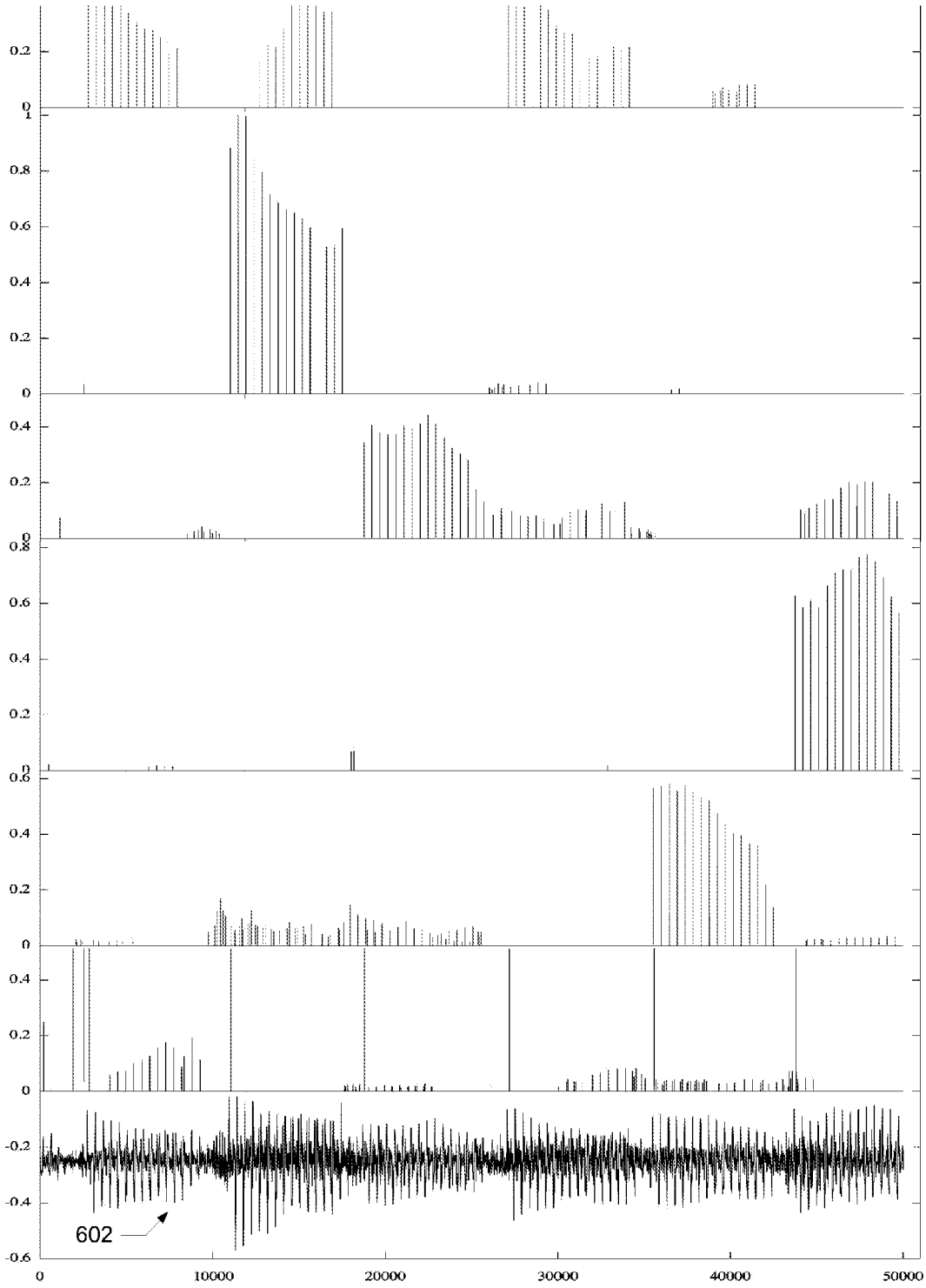

According to a specific embodiment, given a stream of peak segment events, the trajectory classifier maintains a set of trajectories, each including correspondingly admissible events. The trajectories form relative bands of active event amplitudes that track independently the envelopes of the fundamental and overtones. This relationship may be understood with reference to FIG. 6 which illustrates trajectory extraction from signal 602. According to one approach, the primary measure of admission into a trajectory is the absolute ratio between an event and a derivative of events within the trajectory. This derivative is typically weighted heavily against the most recent event; the extreme case being a simple comparison with the most recent event in the trajectory.

Figure 7:
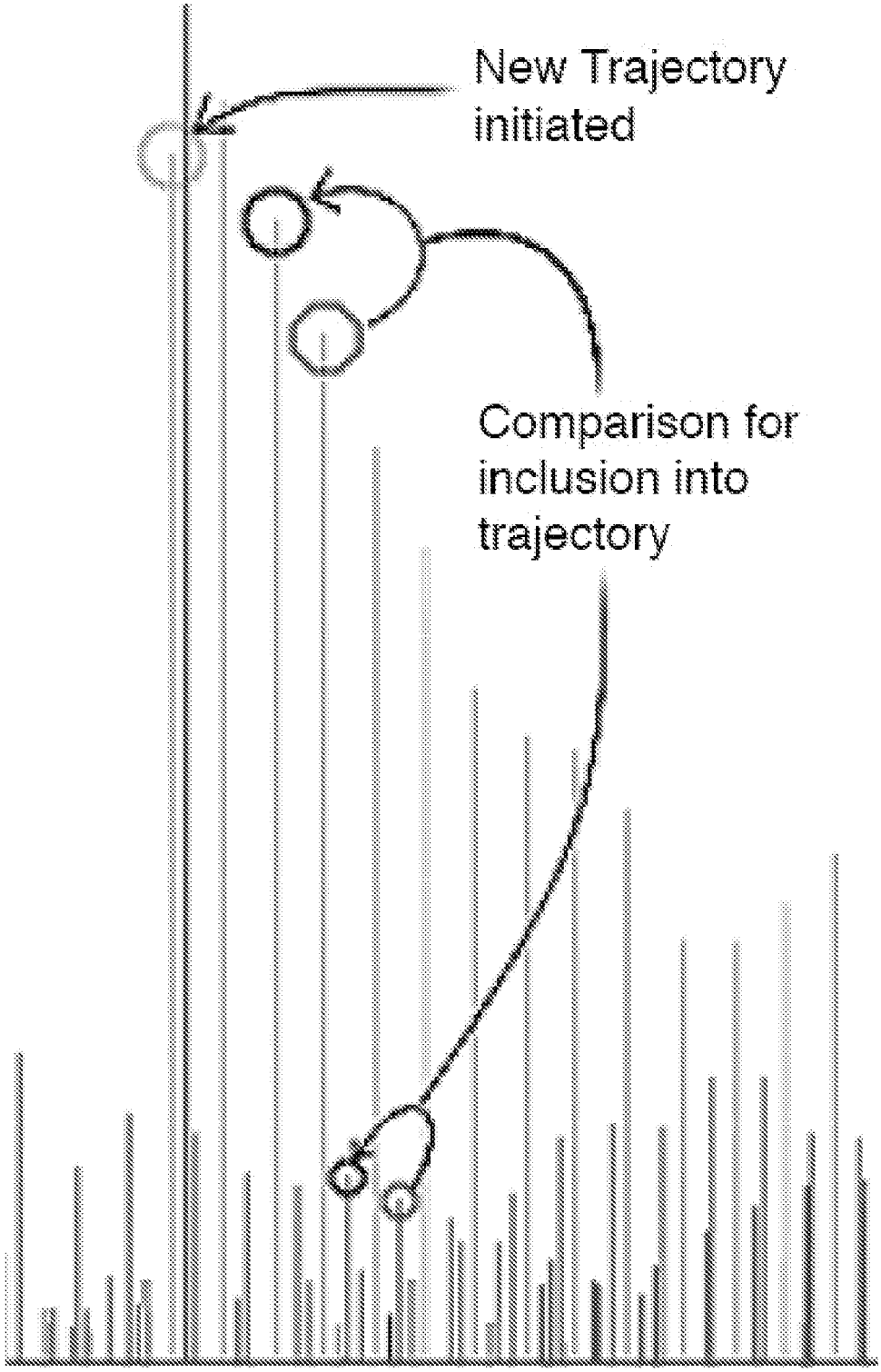

The absolute ratio r is calculated from the event amplitude Ae and the effective trajectory amplitude At using the following relationship: $\log r=|\log Ae-\log At|$. Tested in this manner against each active trajectory, if a trajectory is found to be close within a threshold for maximum absolute ratio the event is added to the trajectory. If the closest trajectory is beyond this threshold for inclusion, or no active trajectories exist, a new trajectory is created from the event. When multiple trajectories admit an event, further classification may be performed by threshold proximity, similarity with other events in the trajectory, and contextual similarity with the relationships between events with the trajectory. In addition, for trajectories that have enough events in them to make such calculations, the effective characteristic of the most recent event in a trajectory can be altered to reflect the projected amplitude and distance of the next event as opposed to the simple characteristics of the most recent event. This is useful because regularity becomes a more indicative means of classification for longer trajectories. A visual illustration of an example of peak comparison for inclusion is provided in FIG. 7.

According to a specific embodiment, while including new events into trajectories, each trajectory is updated to reflect the time since the most recently included event. If the time since the inclusion of the most recent event exceeds a lifetime threshold the trajectory is closed out and removed from active trajectories. Among initiated trajectories, a new trajectory that exceeds the amplitude of all current trajectories is taken to potentially mark the initiation of a performance event. When this occurs a performance event is created and forwarded to the second stage for classification.

The performance event data include the peak segment event from which they were derived along with data indicative of the context of the event relative to other trajectories. Performance events are discarded if they are in sufficiently close proximity to events generated from a nearby segment of opposite polarity. For example, the initial peak created by a performance event often is extracted from a segment of audio that includes a large peak of opposite polarity immediately following a zero crossing. Each trajectory classifier (i.e., for the positive and negative parts of the signal) picks up a corresponding performance event, with the latter of the two being discarded because of its proximity to the former.

According to one class of embodiments, the second stage of the system (e.g., Event Classification 306) receives performance events generated by the first stage and classifies them using a neural network. Included in the performance event data for each event is information pertaining to the characteristics of a peak segment and trajectory context out of which the event was generated. Along with these data, a window of the audio around the generated event is taken for classification analysis. From this window, a corresponding frequency response is computed so that a time and frequency series can be used. The general shape of each of these series along with other metrics are collected into an input vector which is passed to the neural network.

From the neural network, a set of indicators are derived which classify the performance events. Certain performance events are classified as false triggers not indicative of an intentional performance technique. The remaining admissible events are classified by the performance technique that apparently generated them. On a guitar, for example, such techniques include picking the string, tapping the string against the fretboard, "hammering on" the string with the fretting hand, etc.

According to a particular implementation, the topology of the neural network is a set of visible inputs and outputs repeated for sets of classifications that can be trained separately. The training of the network is performed against sets of performance events generated from the first stage and classified manually. The parameters of the neural network can be loaded dynamically to reflect training specific to particular stringed instruments and performance characteristics. In addition, parameters governing operation of the first stage (e.g., Performance Event Extraction 304) can be loaded to optimize performance for similar situations. As shown in FIG. 3, the system can output performance events prior to second stage processing and/or admit externally generated or stored events as direct inputs to the second stage so that each stage can be treated independently.

According to some embodiments, data for trajectories maintained in the first stage may also accessed for use in synthesis. For example, useful envelope information can be obtained from the trajectories as they are updated which can serve to emulate sound characteristics of the performance on stringed instruments. Various outputs of the system may also be used in the recording of a performance, yielding a precise and robust transcription of performance events and auxiliary envelope characteristics.

According to a particular implementation class, the StringPort host application is written in Max/MSP (an authoring system for interactive computer music developed by Miller Puckette). The host application (which is resident on the computer to which the StringPort is connected) enables the extraction of a wide variety of features from the various StringPort outputs such as, for example, a continuous pitch of a fundamental harmonic, amplitude, centroid, brightness, even/odd harmonic balance, noise, spectral shape, complete spectrum, etc., as well as trigger and articulation events. This information is then provided in a format (described below) anticipating the High Definition Protocol for MIDI devices from the MIDI Manufacturers Association (MMA), i.e., the publisher and source of MIDI specifications. Commercial synthesis and notation packages (e.g., Synful Orchestra from Eric Lindemann) may also be modified for control by stringed instruments using the StringPort and the StringPort host application A specific implementation of an interface message format generated by the StringPort host application, referred to herein as an Acoustic Instrument Message (AIM), will now be described. As mentioned above, this format anticipates the new HD MIDI format, and addresses the longstanding problems of guitar synthesis and controllers that are continuous and acoustic in nature (e.g., stringed instruments, brass, woodwinds, etc).

AIM forms the basis of a messaging system that adequately and succinctly transmits descriptors that represent an acoustic instrument's output in such a way so as to readily control a synthesizer. Other applications, e.g., notation, effects control (e.g., visual, robotic, etc.), pedagogy, etc., may also take advantage of these formatted data as well. The formatted data are sent at the frame rate of the analysis (i.e., the process that finds pitch, amplitude, etc.) using a 16 byte (128 bit) message. A specific implementation of such a message is provided in FIG. 8. According to a specific embodiment, an AIM message is sent per instrument string after each analysis window (which is related to FFT frame rate). That is, FFTs run at a specific frame rate based on the number of samples they use for each FFT frame. A frame of 512 sample points at 44.1 KHz corresponds to about 1.16 ms of audio. While this could be accomplished using MIDI 2 single packet messages (SPMs), the overhead may be unacceptable for some applications.

Figure 9:
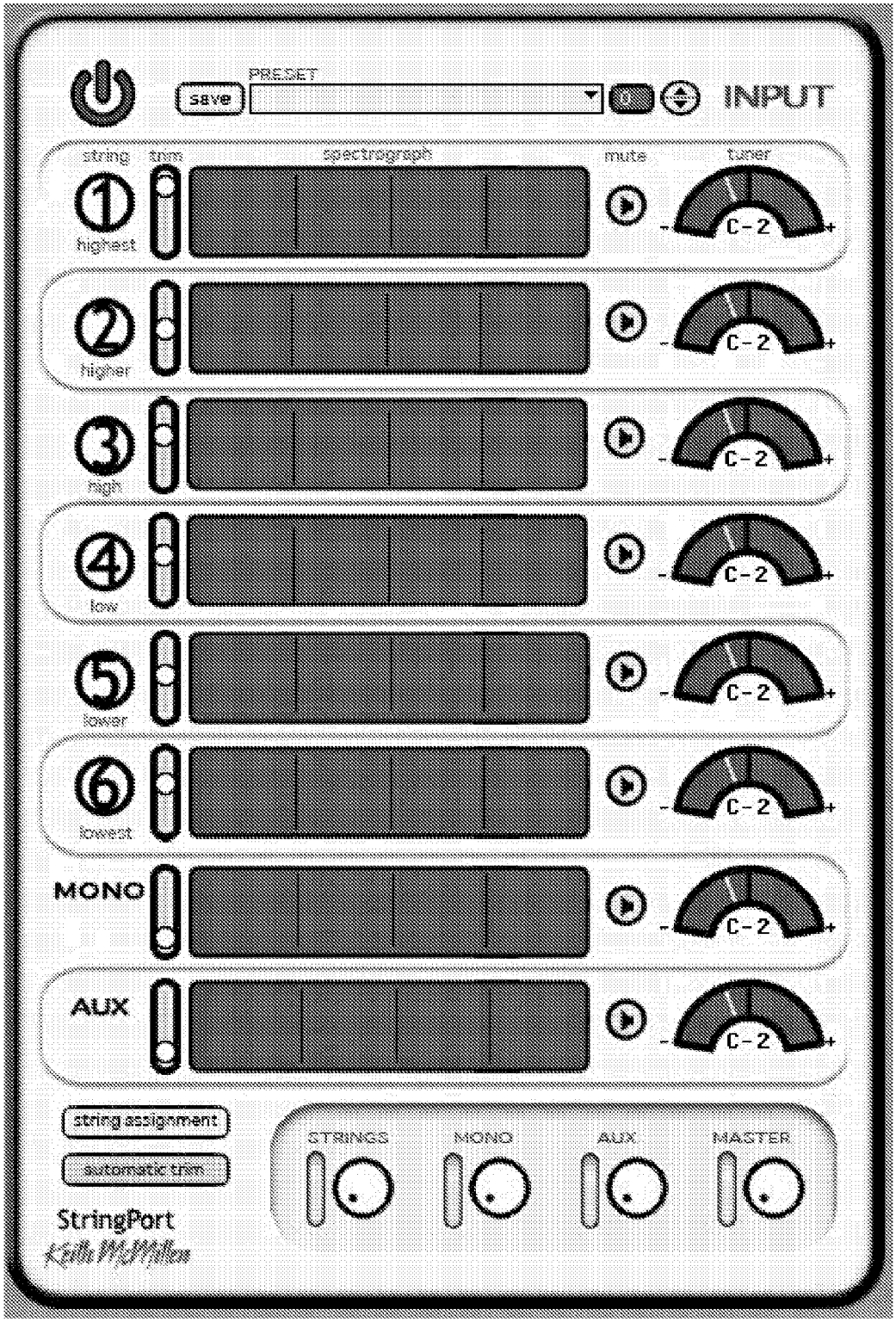
FIGS. 9-13 are representations of graphical user interfaces by which users may interact with various embodiments of the invention.

According to a specific implementation of a host application that receives and processes the StringPort output(s), individual processes are instantiated for each string that enable a wide variety of feature extraction and signal processing capabilities. Various aspects of such functionality are illustrated in the interfaces shown in FIGS. 9-13. The setup screen shown in FIG. 9 allows the user to assign string signals to the different string interfaces 1-6. The gain control for each string controls the digitally controlled analog gain stage in each string signal path (e.g., gain stage 107 of FIG. 1). This accommodates differing input levels, and may be done for each string individually and for the instrument as a whole (i.e., all strings) to ensure, for example, that the analog input from the instrument is optimized for the ADC input range.

According to a specific embodiment, an automatic gain adjustment is provided in which the user strums all of the instrument strings, and the signal level for each string is automatically measured and adjusted to some default level, e.g., −6 dB. The adjustment may then be validated with another strum of the strings. Different sets of gain presets may be stored for different instruments that might have different loudness levels. As shown, each string interface has an associated tuning meter which allows the user to tune each string separately, or even to determine with a single strum whether any of the individual strings are out of tune, e.g., if all of the meters register green the instrument is in tune.

DSP based processes can separate multiple audio sources into their individual sources. Some polyphonic pickups have poor isolation between detecting a single string and often hear adjacent strings. This crosstalk may have multiple magnetic, electrical, or mechanical causes depending on the pickup method and mounting scheme. Therefore, according to some embodiments, the host application or other software running on the host PC can help separate mixed string signals before sending each cleaned up signal onto its chain of processing and analysis.

In addition to accurately determining the pitch of a note, one of the most difficult processing challenges relates to determining when the musician began the note; particularly when the new note is begun on a string that is already in motion. As discussed above, embodiments of the invention include an event capture and classification functionality that employs a time-domain analysis that marks each inflection point (e.g., local maxima and minima) in a string signal waveform, stores these data in an array, and searches through the data with a trained neural net that can accurately determine when an event begins and the event type.

According to a particular implementation, the neural network is trained to determine whether a particular event corresponds to a right hand pick or a left hand trigger (for a right-handed guitarist). This information is extremely useful in that it can be used for processing the string signals in any of a wide variety of ways. For example, this information could be used to distinguish a legato phrasing from a staccato phrasing, and therefore to inform a synthesizer how to articulate the corresponding note(s).

Figure 10:
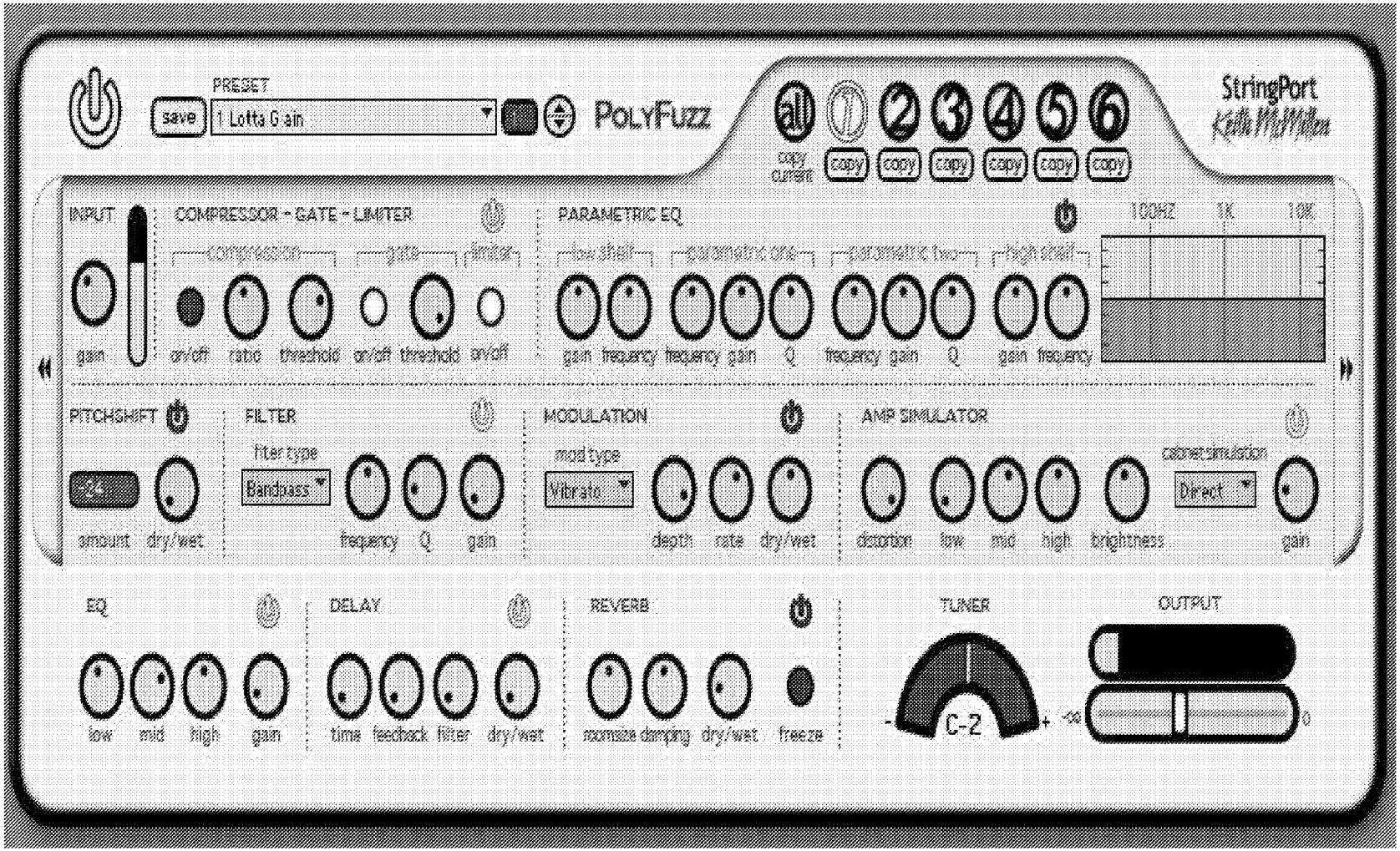

The PolyFuzz application interface shown in FIG. 10 provides a sophisticated array of controls for applying distortion effects to each string of the instrument individually, or collectively (i.e., by selection of the "all" button). Such effects include, for example, compression, dynamics processing, parametric equalization, pitch-shifting, resonant filtering, frequency modulation, amplitude modulation, delay, reverberation, distortion, wave shaping, driving wave tables, stimulating resonances, gating, or limiting, amplifier simulation, equalization, etc.

Figure 11:
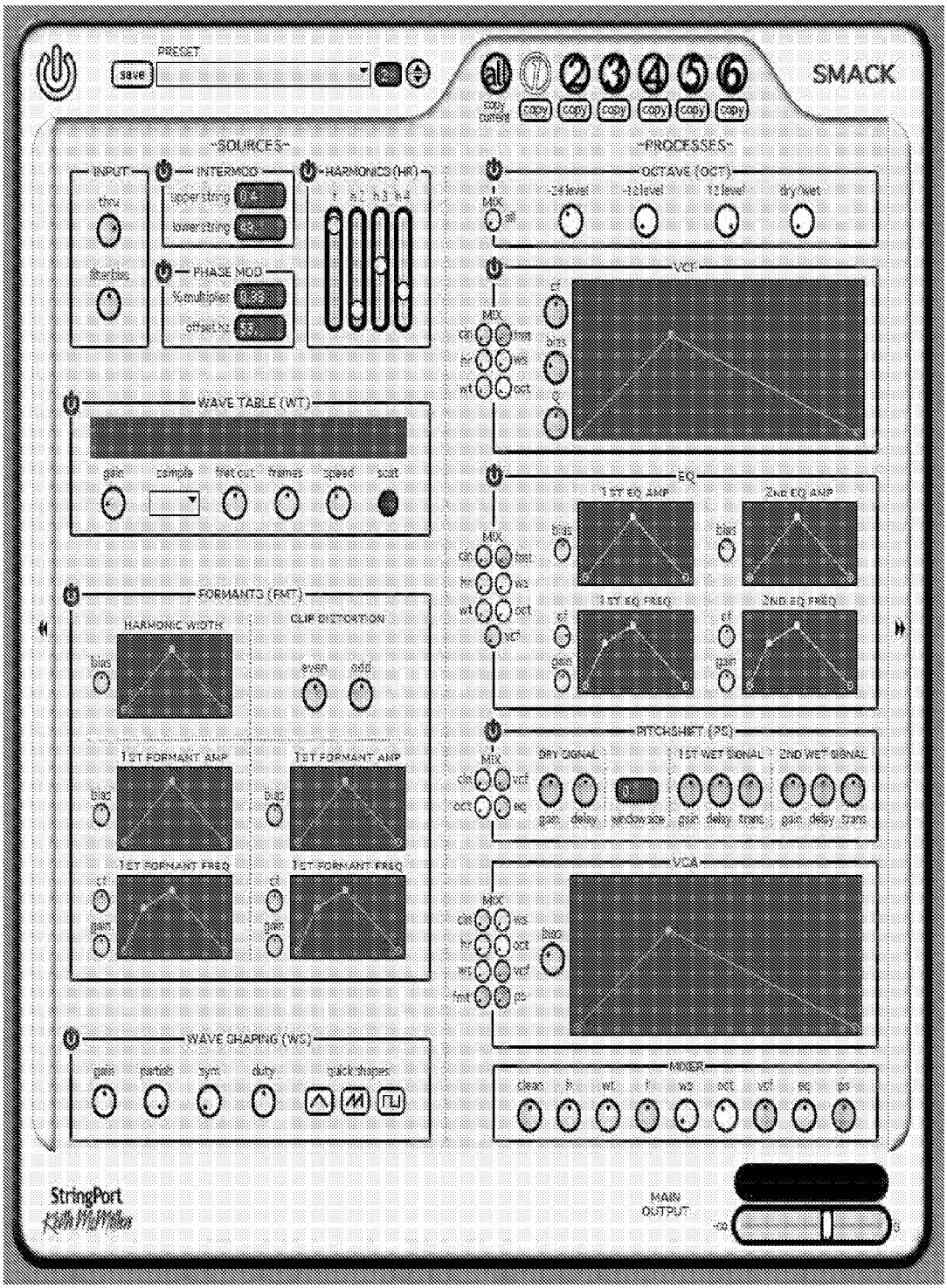

The SMACK application (the interface for which is shown in FIG. 11) is a phase-driven synthesizer and waveform modifier that enables the musician to store a table of sounds, and select from among the sounds in the table based on the phase of the corresponding string.

Figure 12:
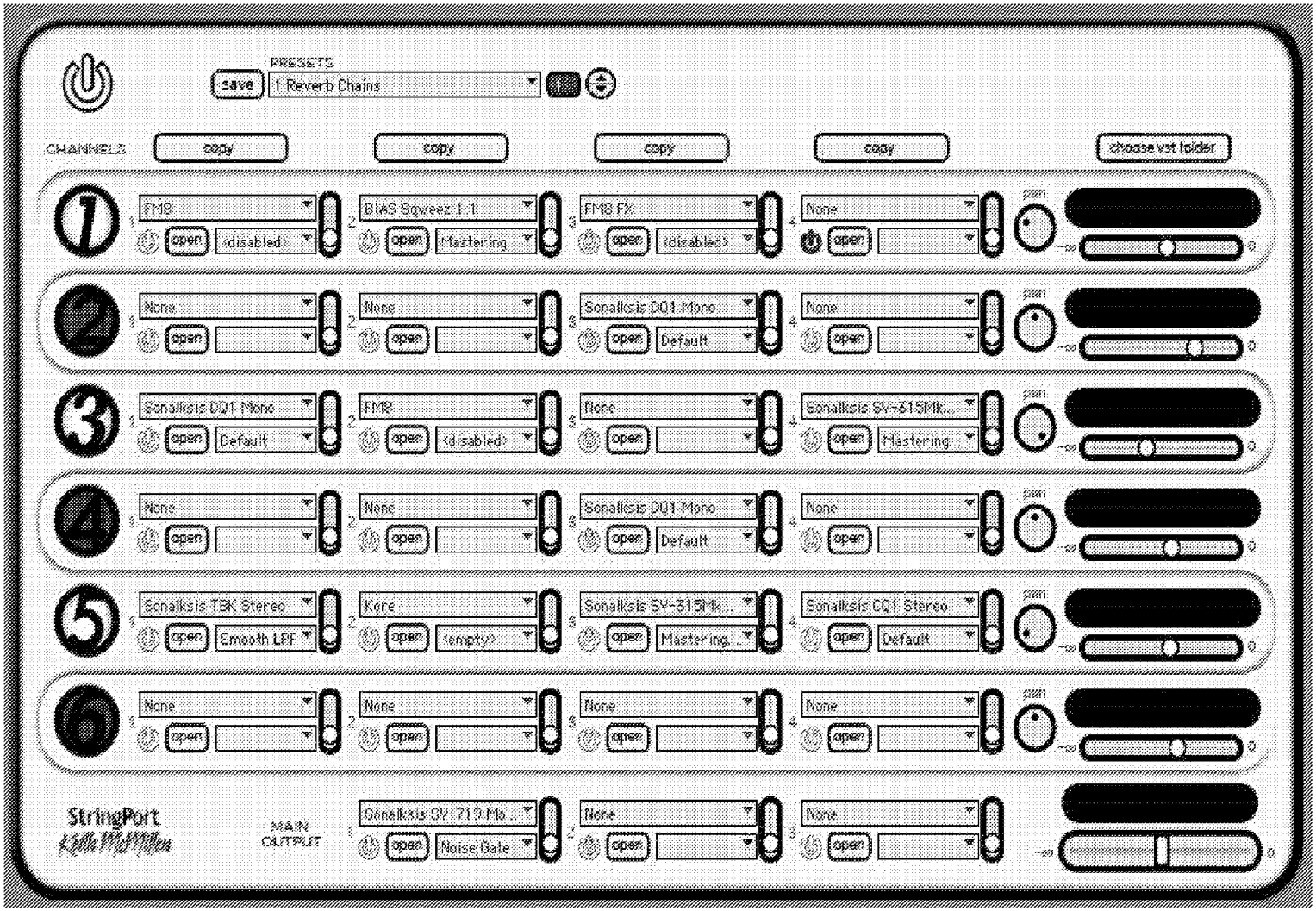
Figure 13:
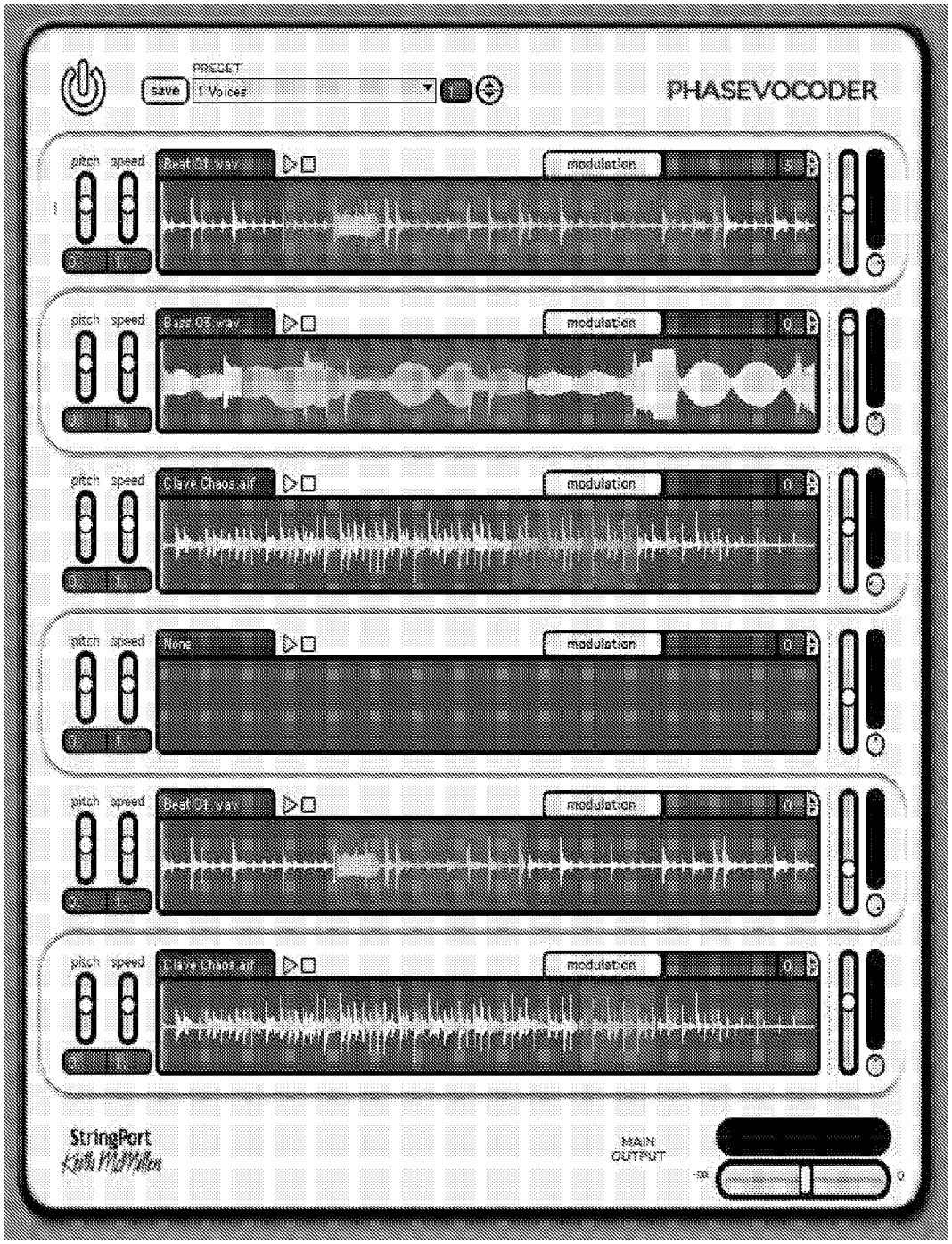

According to a specific embodiment, and as illustrated in the interface of FIG. 12, a VST Wall interface allows the musician to map any of the thousands of existing virtual studio technology modules (VSTs are common industry standard audio processing units) to each string individually, or collectively (up to four VSTs on each string in the example shown).

A set of six Phase Vocoders (see the interface of FIG. 13) allows different audio files to be controlled by characteristics extracted from each string. For example, mapping loudness onto location or pitch onto speed is easily accomplished.

While the invention has been particularly shown and described with reference to specific embodiments thereof, it will be understood by those skilled in the art that changes in the form and details of the disclosed embodiments may be made without departing from the spirit or scope of the invention. For example, particular implementations have been described herein which employ CPU-based data and signal processing techniques. The operation of particular implementations of the code which governs the operation of such CPUs may be understood with reference to the discussion above. Such code may be stored in physical memory or any suitable storage medium associated with the CPUs, as software or firmware, as understood by those of skill in the art. However, it should be noted that the use of a CPU or similar device is not necessary to implement all aspects of the invention. That is, at least some of the functionality described herein may be implemented using alternative technologies without departing from the scope of the invention. For example, embodiments are contemplated which implement such functionalities using programmable or application specific logic devices, e.g., PLDs, FPGAs, ASICs, etc. Alternatively, analog circuits and components may be employed. These and other variations, as well as various combinations thereof, are within the knowledge of those of skill in the art, and are therefore within the scope of the present invention.

Figure 14:
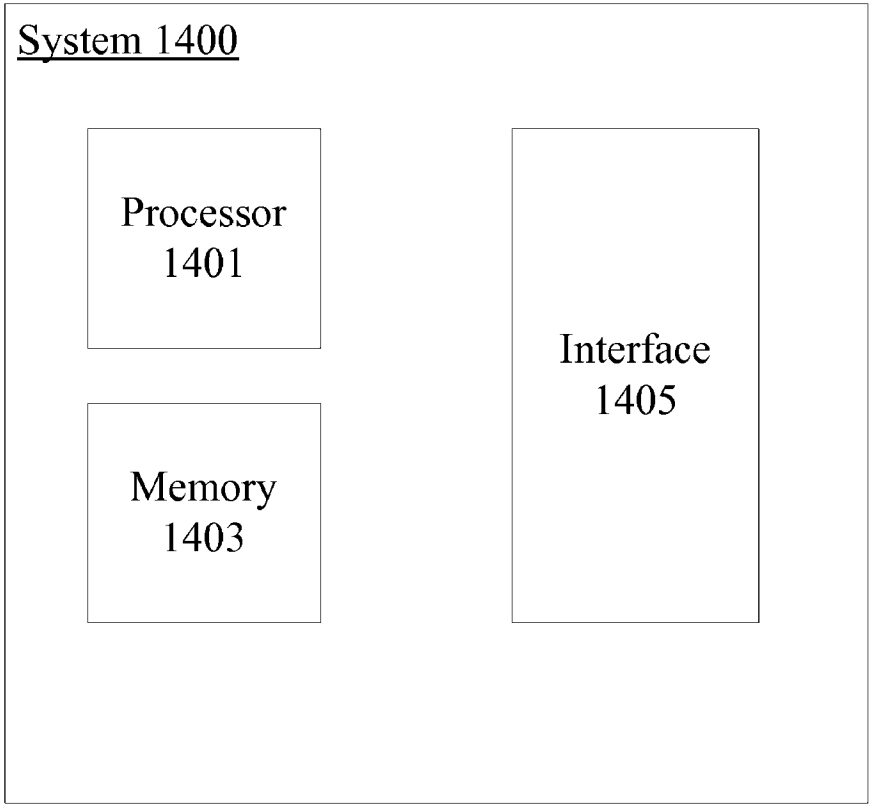
FIG. 14 is an illustration of a computing platform that may be used in conjunction with various embodiments of the invention.

In another example, a host application is described above as being implemented using a particular programming language and using a particular messaging format. However, those of skill in the art will understand that the described functionality may be implemented using any of a wide variety of software and programming tools as well as any of a wide variety of messaging formats. In addition to the diversity of tools and formats that may be employed, such host application functionality may be implemented on a wide variety of computing platforms, an example of which is provided in FIG. 14.

Computing system 1400 is an example of a system suitable for implementing particular embodiments of the present invention, and includes a processor 1401, a memory 1403, and an interface 1405. It should be noted that a variety of components such as caches, buses, controllers, persistent storage, and human interface devices may also be included in system 1400. In particular embodiments, memory 1403 holds instructions for processor 1401 to perform tasks such as, for example, those discussed above with reference to FIGS. 9-13. Various specially configured devices can also be used in place of, or in addition to processor 1401. In some examples, specially configured devices or hardware accelerators may supplement or replace processor tasks. The interface 1405 is typically configured to send and receive data over a network. Particular examples of interfaces include serial, network, frame relay, wireless, satellite, cable, and token ring interfaces.

According to particular example embodiments, the system 1400 uses memory 1403 to store data, algorithms, and program instructions configured to enable various of the functionalities related to the present invention. Such data, algorithms, and program instructions can be obtained from computer-readable media including computer-readable storage, examples of which include magnetic and optical media as well as solid state memory and flash memory devices.

Figure 15:
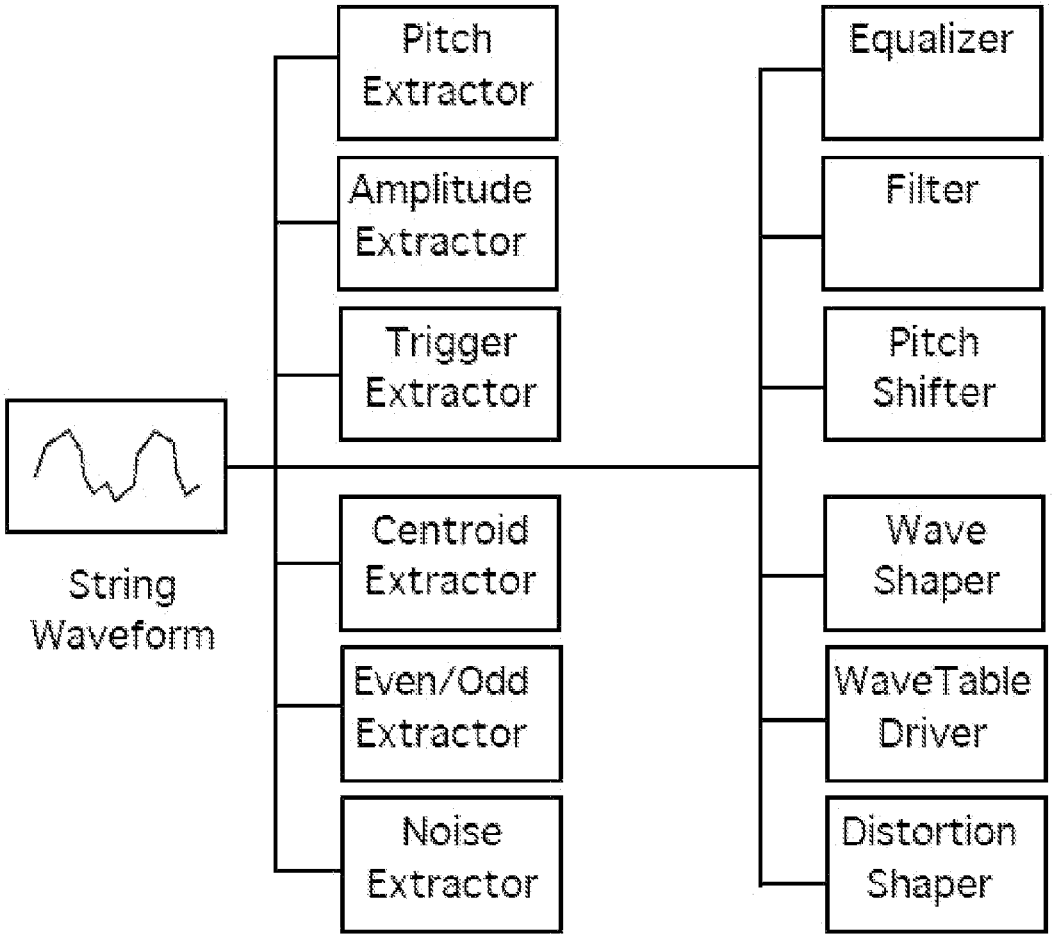
FIG. 15 is an illustration of the parallel processing of string audio in accordance with specific embodiment of the invention.

FIG. 15 is an illustration of the parallel processing of string audio in accordance with specific embodiment of the invention. That is, the figure illustrates how, in accordance with some embodiments, a string's audio may be processed in parallel to simultaneously generate any of the variety of feature extraction data (e.g., pitch, amplitude, etc.), as well as to apply any of the wide variety of audio processing (e.g., equalization, filtering, etc.).

Figure 16:
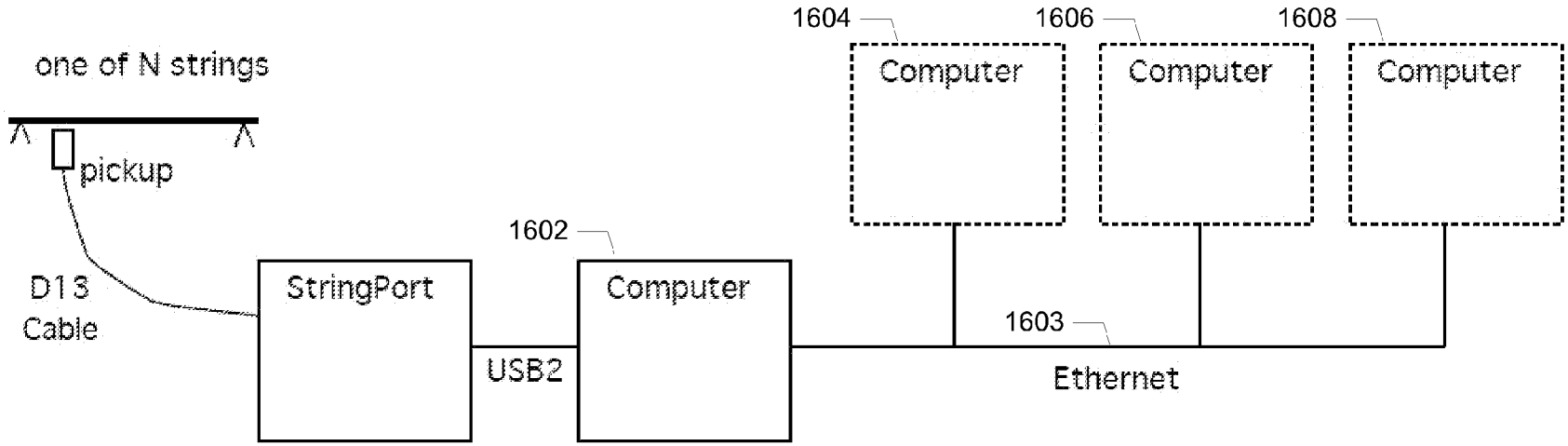
FIG. 16 is an illustration of a network of computing platforms that may be used in conjunction with specific embodiments of the invention.

FIG. 16 is an illustration of a network of computing platforms that may be used in conjunction with specific embodiments of the invention. The path of the polyphonic string audio from string to a computer 1602 is shown. Computer 1602, in turn, is shown connected via an Ethernet infrastructure 1603 to computers 1604, 1606, and 1606 to illustrate the notion that embodiments of the invention support multiprocessor and/or multi-core computing. That is the audio and the extracted feature data may be sent to one or more additional computers on a network where additional CPU power can be used to render synthesized audio as well as additional signal processing. Such information may be moved among applications on various machines using, for example, UDP over Ethernet. This allows for an expansion of processing power not possible in fixed hardware configurations. It will be understood that a wide variety of network configurations and communication protocols may be employed to achieve this expansion without departing from the scope of the invention.

In addition, although various advantages, aspects, and objects of the present invention have been discussed herein with reference to various embodiments, it will be understood that the scope of the invention should not be limited by reference to such advantages, aspects, and objects. Rather, the scope of the invention should be determined with reference to the appended claims.

What is claimed is:

1. A computer-implemented method for processing audio signals for a stringed instrument, comprising:

receiving a serial data stream with a serial data interface of a computing device, the serial data stream encoding a plurality of digital audio signals, each digital audio signal representing one of a plurality of strings of the stringed instrument;

extracting the encoded digital audio signals from the serial data stream using the computing device;

processing each of the extracted digital audio signals with the computing device to detect string events for one or more of the plurality of strings of the stringed instrument, including conducting a time-domain analysis of each of the extracted digital audio signals to identify local maxima and minima associated with each of the extracted digital audio signals in the time domain, and identifying the string events with reference to the local maxima and minima; and classifying each of the string events as corresponding to one of a plurality of performance techniques used by a musician to generate the corresponding string event, the plurality of performance techniques including picking, plucking, tapping, hammering on, and hammering off.

2. The method of claim 1 further comprising processing the extracted digital audio signals including one or more of dynamics processing, equalization, pitch-shifting, filtering, frequency modulation, amplitude modulation, delay, reverberation, distortion, wave shaping, driving wave tables, stimulating resonances, gating, or limiting.

3. The method of claim 1 further comprising processing each of the extracted digital audio signals using a plurality of processing modules that simultaneously process each extracted digital audio signal in both a time domain and a frequency domain.

4. The method of claim 1 further comprising recording each of the digital audio signals for subsequent processing.

5. The method of claim 1 further comprising generating graphical representations corresponding to each of the digital audio signals, the graphical representations representing one or more of pitch, dynamics, or timbre for the corresponding string of the string instrument.

6. The method of claim 1 further comprising controlling a special effect using information extracted from the serial digital stream.

7. The method of claim 1 further comprising identifying a beginning of a note with reference to one or more of the string events.

8. The method of claim 1 wherein classifying the string events is done using a neural network.

9. The method of claim 1 further comprising extracting a plurality of audio signal characteristics from the extracted digital audio signals, wherein processing of the extracted digital audio signals is done with reference to the audio signal characteristics.

10. The method of claim 9 wherein the audio signal characteristics include any of a continuous pitch of a fundamental harmonic of a string, an amplitude, a centroid, brightness, even/odd harmonic balance, noise, spectral shape, or complete spectrum.

11. The method of claim 1 further comprising generating a plurality of acoustic instrument messages with reference to the extracted digital audio signals, each acoustic instrument message summarizing spectral information corresponding to a particular one of the plurality of strings of the stringed instrument.

12. The method of claim 1 wherein conducting the time-domain analysis comprises identifying positive-polarity segments and negative-polarity segments of each extracted digital audio signal, classifying the positive-polarity segments into positive-polarity event candidates and negative-polarity segments into negative-polarity event candidates for each extracted digital audio signal, and classifying at least some of the positive-polarity and negative polarity event candidates for one or more of the extracted digital audio signals as the string events.

13. The method of claim 1 wherein processing each of the extracted digital audio signals comprises tracking a fundamental harmonic and one or more overtones independently.

14. The method of claim 13 further comprising determining a pitch of the fundamental harmonic.

15. The method of claim 14 wherein the pitch of the fundamental harmonic is determined with reference to fret scanning information.

16. The method of claim 13 further comprising determining an even/odd harmonic balance from the fundamental harmonic and the one or more overtones.

17. A computer program product for processing audio signals for a stringed instrument, the computer program product comprising at least one non-transitory computer-readable storage medium having computer program instructions stored therein configured to enable at least one computing device to:

receive a serial data stream with a serial data interface of a computing device, the serial data stream encoding a plurality of digital audio signals, each digital audio signal representing one of a plurality of strings of the stringed instrument;

extract the encoded digital audio signals from the serial data stream using the computing device;

process each of the extracted digital audio signals with the computing device to detect string events for one or more of the plurality of strings of the stringed instrument, including conducting a time-domain analysis of each of the extracted digital audio signals to identify local maxima and minima associated with each of the extracted digital audio signals in the time domain, and identifying the string events with reference to the local maxima and minima; and classify each of the string events as corresponding to one of a plurality of performance techniques used by a musician to generate the corresponding string event, the plurality of performance techniques including picking, plucking, tapping, hammering on, and hammering off.

18. The computer program product of claim 17 wherein the computer program instructions are further configured to enable the at least one computing device to process the extracted digital audio signals using dynamics processing, equalization, pitch-shifting, filtering, frequency modulation, amplitude modulation, delay, reverberation, distortion, wave shaping, driving wave tables, stimulating resonances, gating, or limiting.

19. The computer program product of claim 17 wherein the computer program instructions are further configured to enable the at least one computing device to process each of the extracted digital audio signals using a plurality of processing modules that simultaneously process each extracted digital audio signal in both a time domain and a frequency domain.

20. The computer program product of claim 17 wherein the computer program instructions are further configured to enable the at least one computing device to record each of the digital audio signals for subsequent processing.

21. The computer program product of claim 17 wherein the computer program instructions are further configured to enable the at least one computing device to generate graphical representations corresponding to each of the digital audio signals, the graphical representations representing one or more of pitch, dynamics, or timbre for the corresponding string of the string instrument.

22. The computer program product of claim 17 wherein the computer program instructions are further configured to enable the at least one computing device to control a special effect using information extracted from the serial digital stream.

23. The computer program product of claim 17 wherein the computer program instructions are further configured to enable the at least one computing device to identify a beginning of a note with reference to one or more of the string events.

24. The computer program product of claim 17 wherein the computer program instructions are configured to enable the at least one computing device to classify the string events using a neural network.

25. The computer program product of claim 17 wherein the computer program instructions are further configured to enable the at least one computing device to extract a plurality of audio signal characteristics from the extracted digital audio signals, and process the extracted digital audio signals with reference to the audio signal characteristics.

26. The computer program product of claim 25 wherein the audio signal characteristics include any of a continuous pitch of a fundamental harmonic of a string, an amplitude, a centroid, brightness, even/odd harmonic balance, noise, spectral shape, or complete spectrum.

27. The computer program product of claim 17 wherein the computer program instructions are further configured to enable the at least one computing device to generate a plurality of acoustic instrument messages with reference to the extracted digital audio signals, each acoustic instrument message summarizing spectral information corresponding to a particular one of the plurality of strings of the stringed instrument.

28. The computer program product of claim 17 wherein the computer program instructions are configured to enable the at least one computing device to conduct the time-domain analysis by identifying positive-polarity segments and negative-polarity segments of each extracted digital audio signal, classifying the positive-polarity segments into positive-polarity event candidates and negative-polarity segments into negative-polarity event candidates for each extracted digital audio signal, and classifying at least some of the positive-polarity and negative polarity event candidates for one or more of the extracted digital audio signals as the string events.

29. The computer program product of claim 17 wherein the computer program instructions are configured to enable the at least one computing device to process each of the extracted digital audio signals by tracking a fundamental harmonic and one or more overtones independently.

30. The computer program product of claim 29 wherein the computer program instructions are further configured to enable the at least one computing device to determine a pitch of the fundamental harmonic.

31. The computer program product of claim 30 wherein the computer program instructions are configured to enable the at least one computing device to determine the pitch of the fundamental harmonic with reference to fret scanning information.

32. The computer program product of claim 29 wherein the computer program instructions are further configured to enable the at least one computing device to determine an even/odd harmonic balance from the fundamental harmonic and the one or more overtones.

* * * * *